US007121877B2

(12) United States Patent
Lin

(10) Patent No.: US 7,121,877 B2
(45) Date of Patent: Oct. 17, 2006

(54) PLUG ADAPTOR ASSEMBLY FOR CONNECTING ELECTRICALLY AN ELECTRONIC INSTRUMENT TO A POWER SOURCE

(76) Inventor: Hsueh-Lan Lin, 1F, No. 11, Alley 20, Lane 318, Sec. 2, Chung Shan Road, Pan Chiao City, Taipei Hsien (TW)

( * ) Notice: Subject to any disclaimer, the term of this patent is extended or adjusted under 35 U.S.C. 154(b) by 0 days.

(21) Appl. No.: 10/958,367

(22) Filed: Oct. 6, 2004

(65) Prior Publication Data

US 2005/0255743 A1 Nov. 17, 2005

(30) Foreign Application Priority Data

May 11, 2004 (TW) ..... 93113147 A

(51) Int. Cl.
*H01R 11/00* (2006.01)

(52) U.S. Cl. ..... 439/502

(58) Field of Classification Search ..... 439/502, 439/501, 528, 369; 248/65; 361/826
See application file for complete search history.

(56) References Cited

U.S. PATENT DOCUMENTS 4,067,526 A * 1/1978 Storer ..... 248/65
5,507,667 A * 4/1996 Hahn et al. ..... 439/501
5,720,628 A * 2/1998 Usui et al. ..... 439/502
D400,175 S * 10/1998 Okamoto ..... D13/139.7
6,402,546 B1 * 6/2002 Groves et al. ..... 439/501
6,428,348 B1 * 8/2002 Bean ..... 439/501
6,433,274 B1 * 8/2002 Doss et al. ..... 174/50
6,567,277 B1 * 5/2003 Doherty et al. ..... 361/826
6,589,069 B1 * 7/2003 Liao ..... 439/501
6,705,891 B1 * 3/2004 Lin ..... 439/528
6,722,917 B1 * 4/2004 Huang ..... 439/501
2002/0106933 A1 * 8/2002 Lee ..... 439/501

* cited by examiner

*Primary Examiner*—Alexander Gilman
(74) *Attorney, Agent, or Firm*—Berkeley Law & technology Group, LLC

(57) ABSTRACT

A plug adaptor assembly includes a plug member having an insert end formed with a plurality of terminals; an adaptor member having one end formed with a plug hole, a plurality of terminals disposed within the plug hole in the end, and a mounting portion; and a connecting cable having opposite ends respectively connected to a mounting end of the plug member and the other end of the adaptor member for establishing electrical connection between the terminals of the plug member and the terminals of the adaptor member. When required, the mounting end of the plug member can be disposed on the mounting portion of the adaptor member.

8 Claims, 12 Drawing Sheets

PLUG ADAPTOR ASSEMBLY FOR CONNECTING ELECTRICALLY AN ELECTRONIC INSTRUMENT TO A POWER SOURCE

FIELD OF THE INVENTION

The invention relates to a plug adaptor assembly, more particularly to a plug adaptor assembly for connecting an electronic instrument electrically to a power source and which is adapted to be kept in a neat-and-tidy manner when required.

BACKGROUND OF THE INVENTION

When we want to use an electronic instrument, such as a scanning apparatus, the plug of the scanning apparatus is inserted in a wall outlet which, in turn, is connected electrically to an electrical power source in the house. Sometimes, the wall outlet may be shielded by a large furniture or is already occupied by the plug of another electronic instrument already present in the house, a plug adaptor assembly is required in order to connect all the electronic instruments electrically to the power source. In addition, there are limited number of wall outlets in a room, but there may be several domestic electronic instruments in the same room, such as a TV set, an air conditioner, a washing machine, an electric oven and so forth, all of which require electrical power for operating the same.

Referring to FIG. 1, a conventional plug adaptor assembly 10 is shown to include a plug member 104 inserted into the wall outlet (not visible) so as to be in electrical communication with a power source, and an adaptor member 102 formed with two plug holes 106, 108 of different standard dimensions. When desired, the plugs of two different electronic instruments can be inserted respectively into the plug holes 106, 108 of the adaptor member 102. One drawback of the aforesaid conventional plug adaptor assembly 10 resides in that the electronic instruments being used must be disposed adjacent to the wall outlet, thereby unnecessarily restricting the utility range of the electronic instruments.

Referring to FIG. 2, another conventional plug adaptor assembly 20 is shown to include a plug member 104, a connecting cable 202, and an adaptor member 102. The plug member 104 is formed with a plurality of terminals, and is adapted to be inserted into the wall outlet 126 in the wall 122 so as to establish electrical communication between the terminals 128 of the wall outlet 126 and the terminals of the plug member 104. The adaptor member 102 has a rear end formed with two plug holes 106, 108 of different standard dimensions. The connecting cable 202 has two opposite ends respectively connected to the plug member and the adaptor body 102. Though the electronic instrument being used can be disposed rather away from the wall outlet 126 by employment of this conventional plug adaptor assembly, the connecting cable 202 is exposed to the ambient surrounding, which consequently affects the aesthetic effect the entire environment.

Buying different types of conventional plug adaptor assemblies can result in an extra expense and storing the same when not in use is inconvenient to the user.

SUMMARY OF THE INVENTION

The object of the present invention is to provide a plug adaptor assembly which has a simple construction and which can be used under different conditions, thereby eliminating the need to buy two plug adaptor assemblies.

In one aspect of the present invention, a plug adaptor assembly is provided for mounting on a wall that has a wall outlet formed with a plurality of terminals therein. The plug adaptor assembly includes: a plug member having an insert end formed with a plurality of terminals, and a mounting end opposite to the insert end, the insert end of the plug member being adapted to be inserted into the wall outlet in the wall for establishing electrical connection between the terminals of the wall outlet and the terminals on the insert end; an adaptor member having a first end, a second end formed with a plug hole, a plurality of terminals disposed within the plug hole in the second end, and a mounting portion disposed between the first and second ends; and a connecting cable having opposite ends respectively connected to the mounting end of the plug member and the first end of the adaptor member for establishing electrical connection between the terminals of the plug member and the terminals of the adaptor member. When circumstance required, the mounting end of the plug member can be disposed detachably on the mounting portion of the adaptor member in order to keep the plug adaptor assembly in a neat-and-tidy manner.

In anther aspect of the present invention, a plug adaptor assembly is provided for mounting on a wall that has a wall outlet formed with a plurality of terminals therein. The plug adaptor assembly includes: a plug member having an insert end formed with a plurality of terminals, a mounting end opposite to the insert end, upper and lower sides interconnecting the insert end and the mounting end, upper and lower sticks projecting outwardly from the mounting end and respectively flush with upper and lower sides of the plug member, the insert end of the plug member being adapted to be inserted into the wall outlet in the wall for establishing electrical connection between the terminals of the wall outlet and the terminals on the insert end; an adaptor member having a first end, a second end formed with a plug hole, a plurality of terminals disposed within the plug hole in the second end, and a mounting portion disposed between the first and second ends and formed with two grooves; and a connecting cable having opposite ends respectively connected to the mounting end of the plug member and the first end of the adaptor member for establishing electrical connection between the terminals of the plug member and the terminals of the adaptor member. When circumstance required, the upper and lower sticks of the plug member can be respectively inserted into the grooves in the adaptor member so as to retain the plug member on the adaptor member, thereby keeping the plug adaptor assembly in a neat-and-tidy manner.

BRIEF DESCRIPTION OF THE DRAWING

Other features and advantages of this invention will become more apparent in the following detailed description of the preferred embodiments of this invention, with reference to the accompanying drawings, in which.

DETAILED DESCRIPTIONS OF THE PREFERRED EMBODIMENTS

Figure 1:
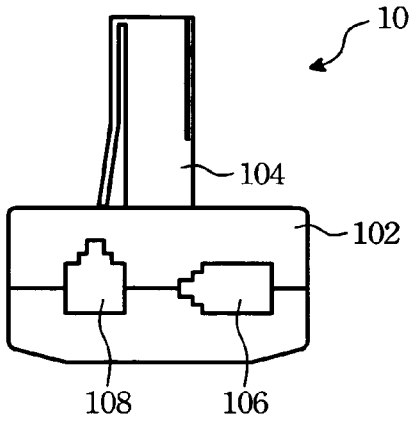
Fig. 1 (Prior Art)
FIG. 1 is a front view, illustrating how a conventional plug adaptor assembly is mounted in a wall outlet.
Figure 2:
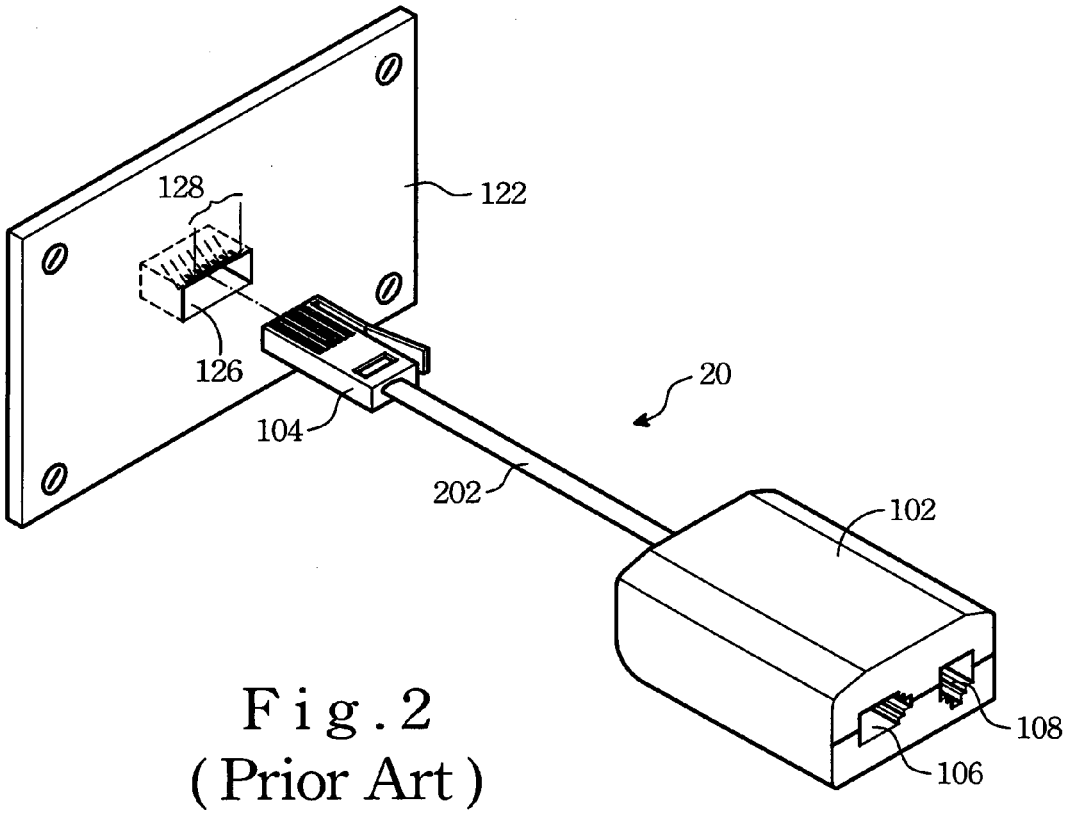
Fig. 2 (Prior Art)
FIG. 2 is a perspective schematic view of another conventional plug adaptor assembly prior to inserting into a wall outlet.
Figure 3A:
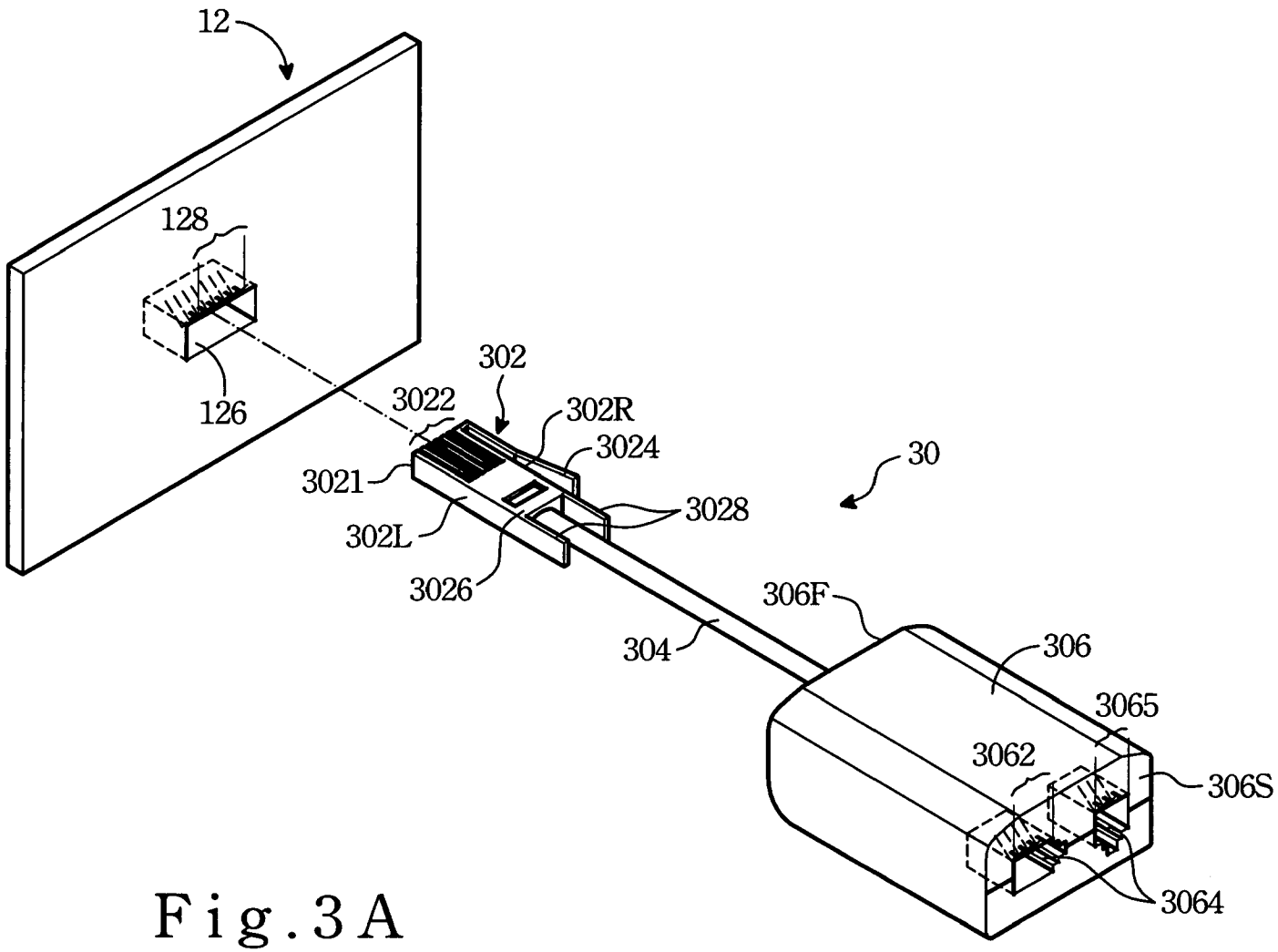
FIG. 3A is a perspective schematic view of the first embodiment of a plug adaptor assembly according to the present invention prior to inserting into a wall outlet.

Referring to FIG. 3A, a perspective view of the first embodiment 30 of a plug adaptor assembly according to the present invention is adapted to be mounted on a wall 12 that has a wall outlet 126 formed with a plurality of terminals 128. The first embodiment includes a plug member 302, an adaptor member 306 and a connecting cable 304.

Figure 3B:
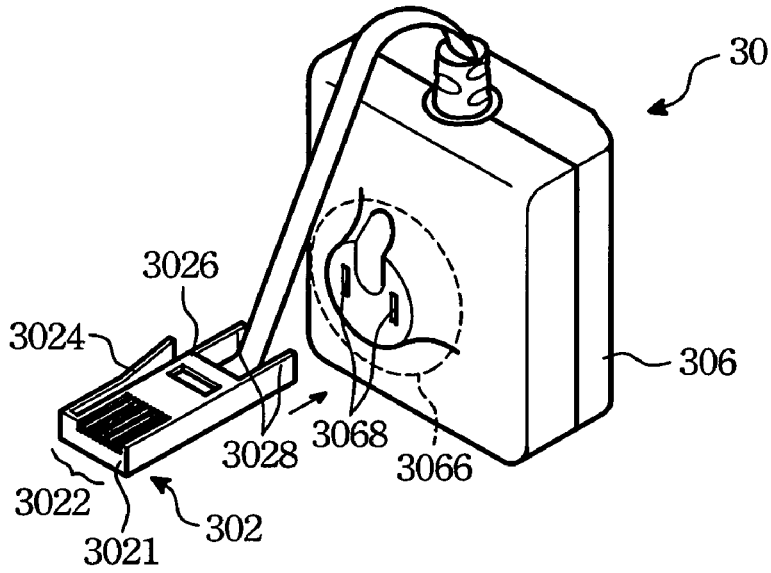
FIG. 3B is another perspective schematic view of the first embodiment of the plug adaptor assembly according to the present invention.

As illustrated, each of the plug and adaptor members 302, 306 is made from a dielectric material. The plug member 302 has an insert end 3021 formed with a plurality of terminals 3022, a mounting end 3026 opposite to the insert end 3021, a resilient finger 3024 integrally formed with the insert end 3021, a retaining stick unit 3028 projecting outwardly and axially from the mounting end 3026. The adaptor member 306 has a first end 306F, a second end 306S formed with two plug holes 3064 of different standard dimensions, a plurality of terminals 3062 disposed within the plug holes 3064 in the second end 306S, and a mounting portion 3066 disposed between the first and second ends 306F, 306S. The mounting portion 3066 of the adaptor member 306 is preferably formed with a retention groove unit 3068. The connecting cable 304 has two opposite ends respectively connected to the mounting end 3026 of the plug member 302 and the first end 306F of the adaptor member 306 for establishing electrical connection between the terminals 3022 of the plug member 302 and the terminals 3062 of the adaptor member 306. When circumstance required, the retaining stick unit 3028 of the mounting end 3026 can be inserted into the retention groove unit 3068 of the adaptor member 306 (see FIG. 3B), thereby permitting resting of the plug member 302 on the adaptor member 306. Under this condition, the plug adaptor assembly 30 is thus kept in a neat-and-tidy manner, and can be mounted on the wall 12, as best shown in FIG. 3C.

Figure 3C:
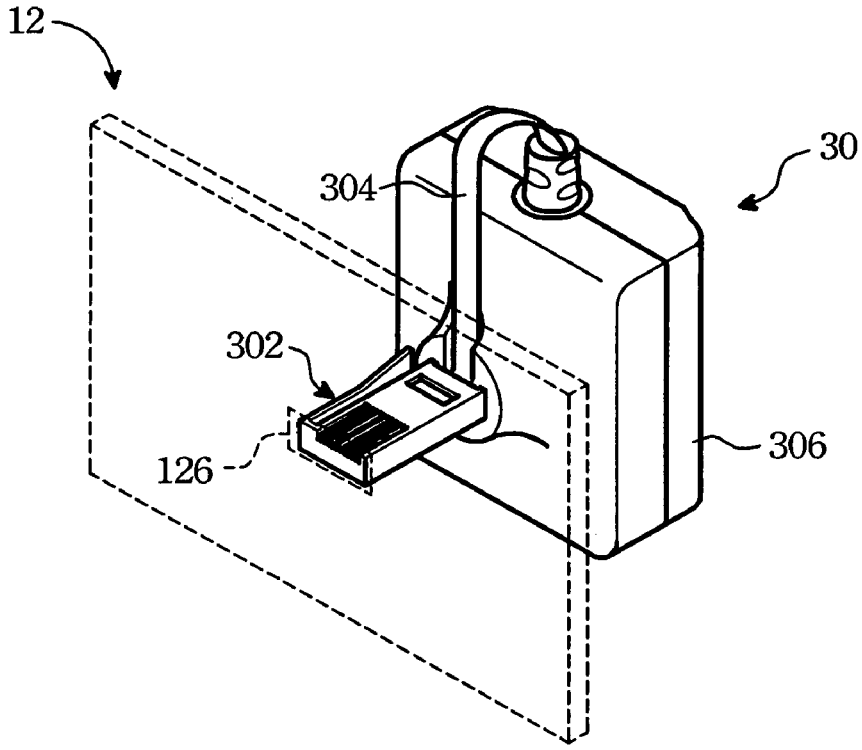
FIG. 3C is a perspective schematic view of the first embodiment of the plug adaptor assembly according to the present invention in use.

Referring to FIGS. 3A and 3C, when it is desired to use the first embodiment, an external force is applied onto the resilient finger 3024 in such a manner to reduce the width of the plug member 302, and the latter is inserted into the wall outlet 126. The insert end 3021 is retained securely within the wall outlet 126 upon removal of the external force, thereby permitting an electrical connection between the terminals 128 of the wall outlet 126 and the terminals 3022 on the insert end 3021 of the plug member 302.

In the first embodiment, the plug member 302 has left and right lateral sides 302L, 302R interconnecting the insert end 3021 and the mounting end 3026. The retention groove unit 3068 includes two parallel grooves formed in the mounting portion 3066 of the adaptor member 306. The retaining stick unit 3028 includes left and right sticks respectively flush with the left and right lateral sides 302L, 302R of the plug member 302, and extending respectively into the retention grooves. Under this condition, the connecting cable 304 is confined between the left and right sticks, and is pressed by the mounting end 3026 against the mounting portion 3066 of the adaptor member 306.

Figure 4A:
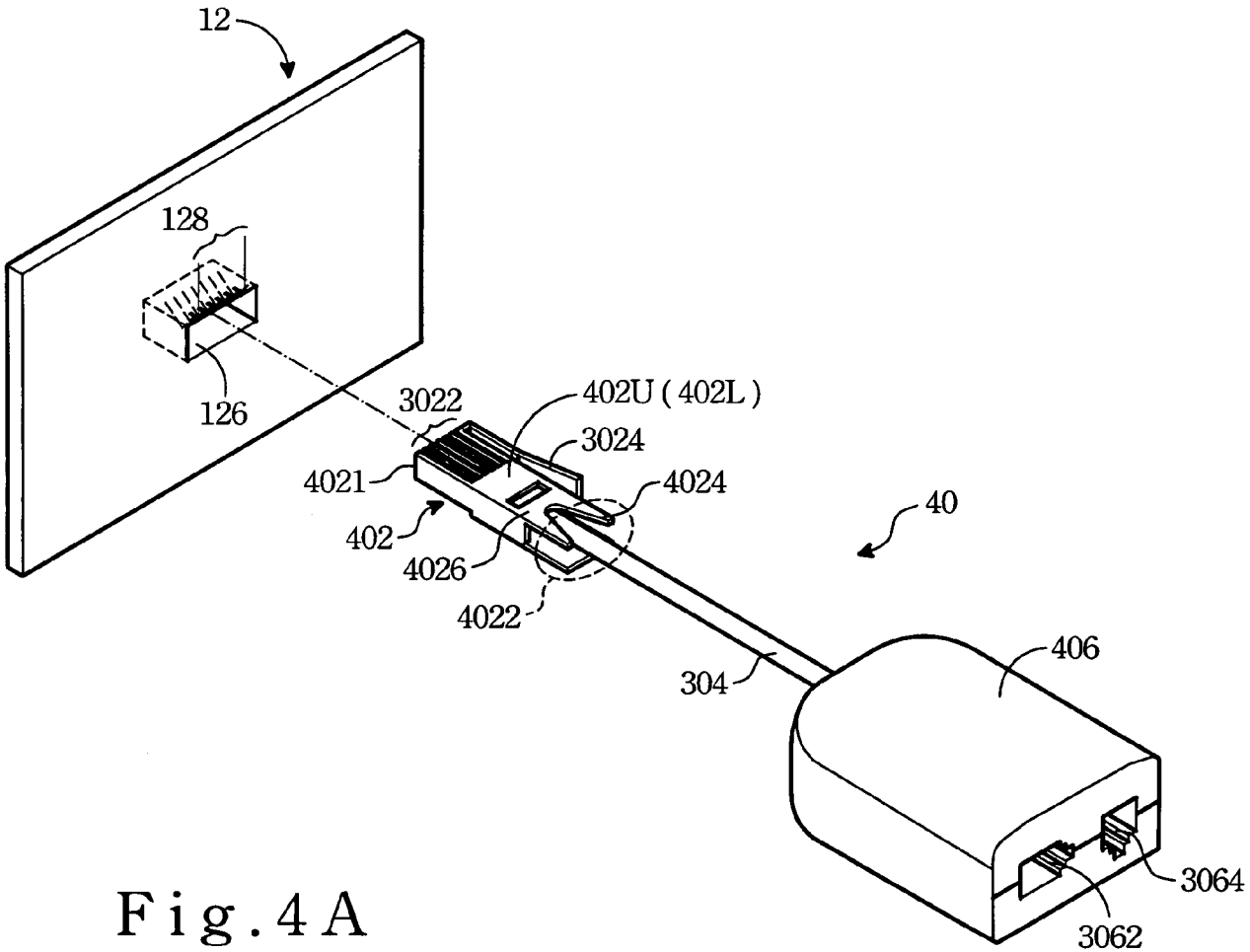
FIG. 4A is a perspective schematic view of the second embodiment of a plug adaptor assembly according to the present invention prior to inserting into a wall outlet.
Figure 4B:
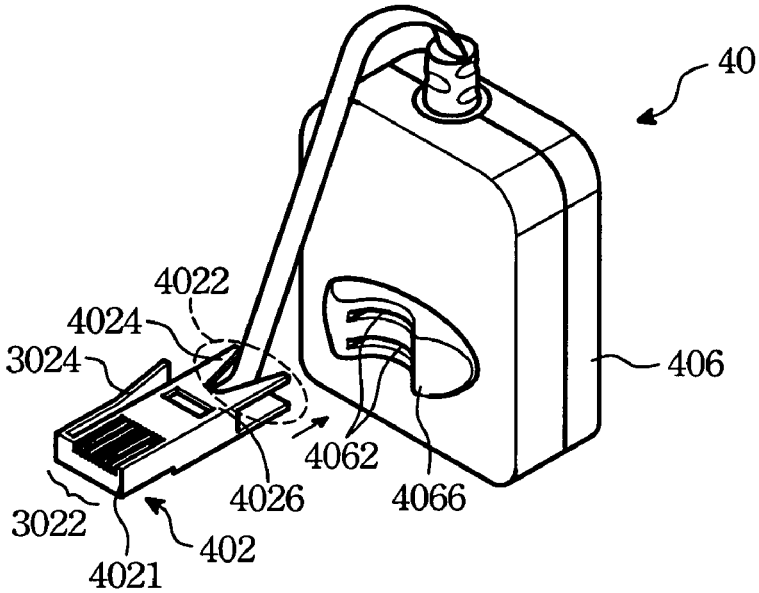
FIG. 4B is another perspective schematic view of the second embodiment of the plug adaptor assembly according to the present invention.
Figure 4C:
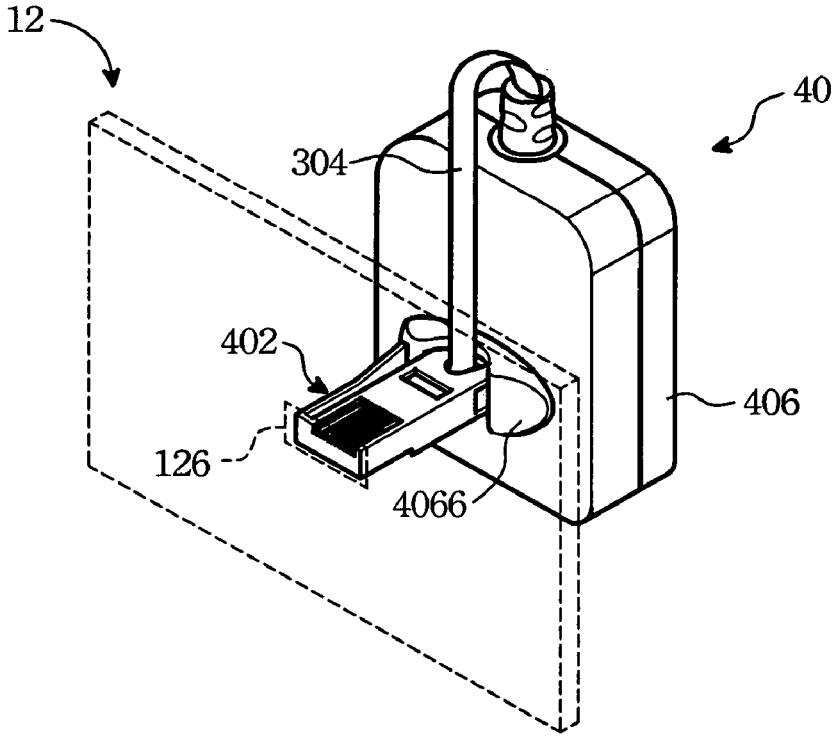
FIG. 4C is a perspective schematic view of the second embodiment of the plug adaptor assembly according to the present invention in use.

Referring to FIGS. 4A, 4B and 4C, the second embodiment 40 of a plug adaptor assembly according to the present invention is shown to have a construction similar to the first embodiment. The main difference resides in that the plug member 402 has upper and lower sides 402U, 402L interconnecting the insert end 4021 and the mounting end 4026. The retention groove unit includes two parallel retention grooves 4062 formed in the mounting portion 3066 of the adaptor member 406. The retaining stick unit 4022 includes upper and lower sticks 4024 respectively flush with the upper and lower sides 402U, 402L of the plug member 402, and extending respectively into the parallel retention grooves 4062 in the mounting portion 4066. In addition, each of the upper and lower sticks 4024 further has a distal end formed with a V-shaped notch confining the connecting cable 304 therein. When the upper and lower sticks 4024 are respectively inserted into the parallel retention grooves 4062 in the adaptor member 406, the connecting cable 304 is pressed against the mounting portion 4066 of the adaptor member 406.

Figure 5A:
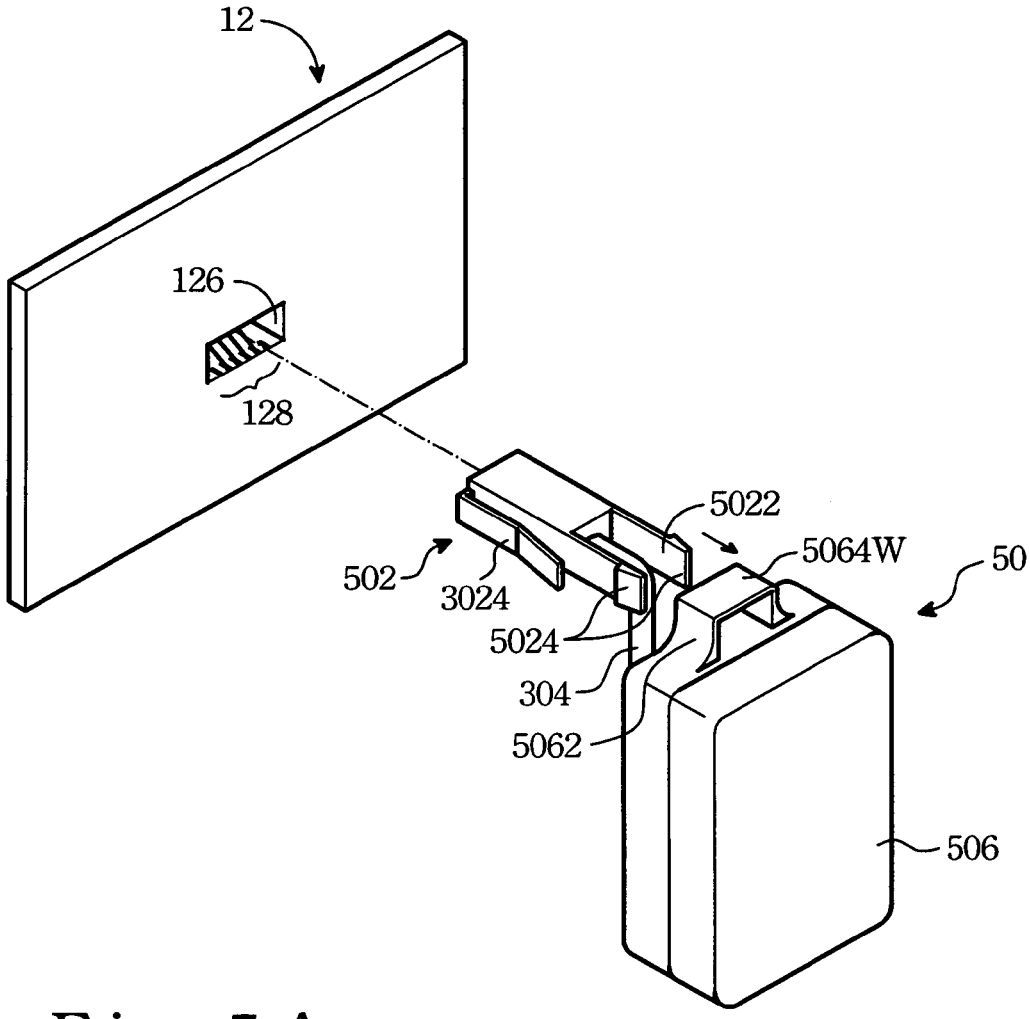
FIG. 5A is a perspective schematic view of the third embodiment of a plug adaptor assembly according to the present invention prior to inserting into a wall outlet.
Figure 5B:
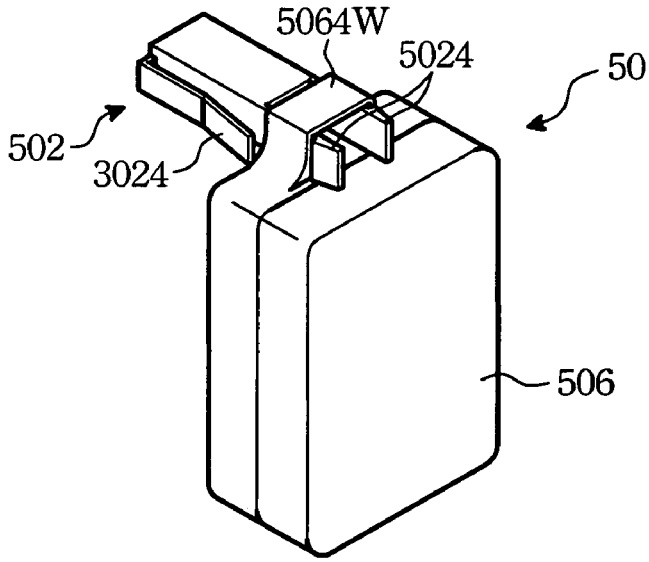
FIG. 5B is another perspective schematic view of the third embodiment of the plug adaptor assembly according to the present invention.
Figure 5C:
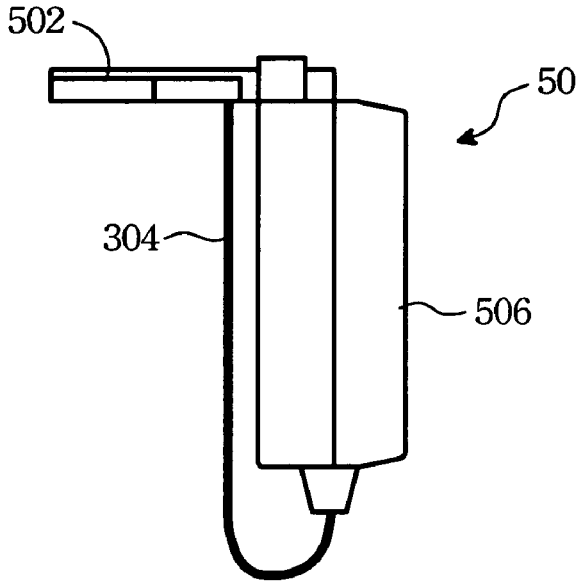
FIG. 5C is a schematic side view of the third embodiment of the plug adaptor assembly according to the present invention.

Referring to FIGS. 5A, 5B and 5C, the third embodiment 50 of a plug adaptor assembly according to the present invention is shown to have a construction similar to the first embodiment. The main difference resides in that the retention groove unit 5062 is a hollow groove of rectangular cross-section, and is confined by a groove-defining wall 5064W having opposite outer and inner ends. Each of the left and right sticks 5022 has a distal end formed with an engaging tongue 5024. When the left and right sticks 5022 are inserted into the hollow groove 5064, the engaging tongues 5024 of the left and right sticks 5022 engage the periphery defining the inner end of the groove-defining wall 5064W (see FIG. 5B), thereby preventing untimely removal of the left and right sticks 5022 of the plug member 502 from the adapted member 506.

Figure 6A:
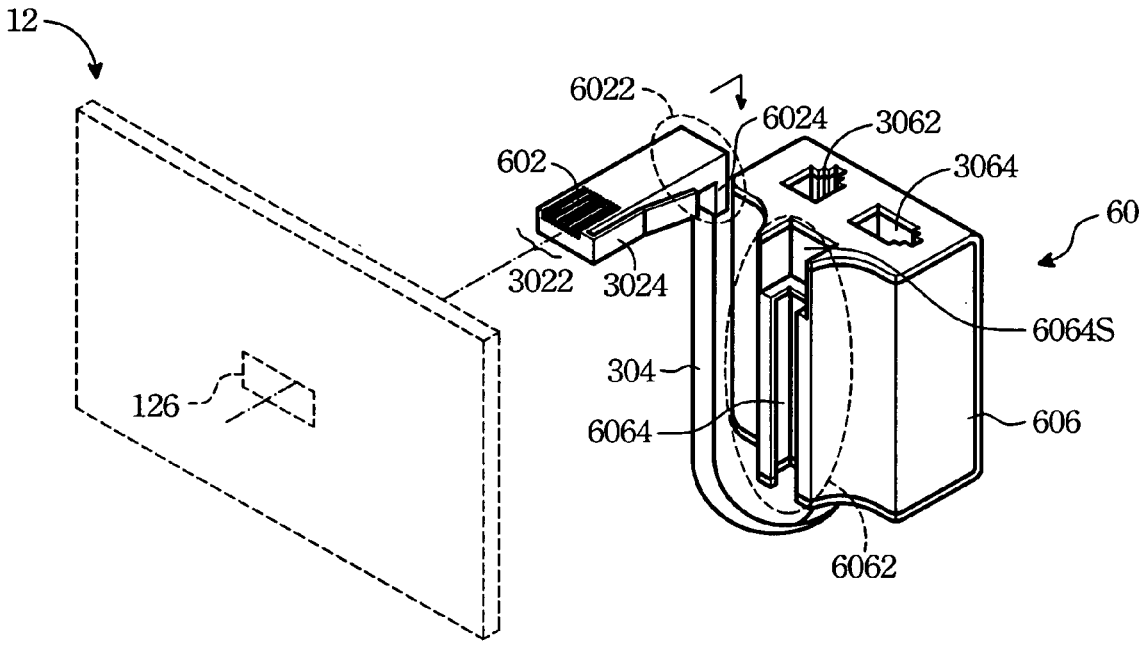
FIG. 6A is a perspective schematic view of the fourth embodiment of a plug adaptor assembly according to the present invention prior to inserting into a wall outlet.
Figure 6B:
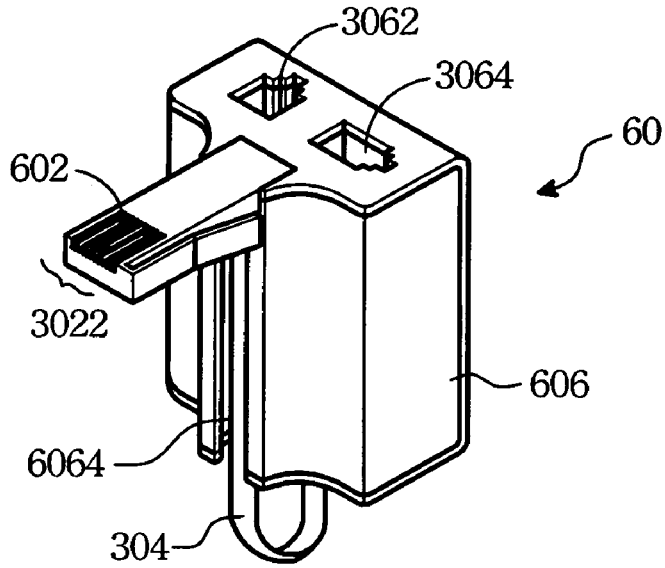
FIG. 6B is another perspective schematic view of the fourth embodiment of the plug adaptor assembly according to the present invention.
Figure 6C:
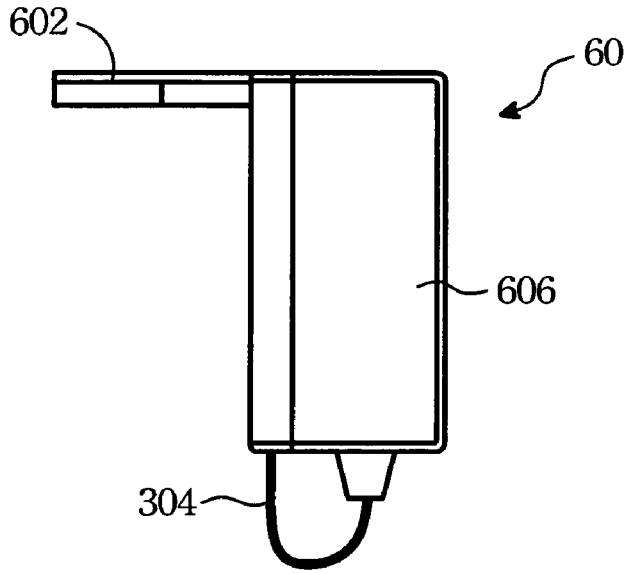
FIG. 6C is a schematic side view of the fourth embodiment of the plug adaptor assembly according to the present invention.

Referring to FIGS. 6A, 6B and 6C, the fourth embodiment 60 of a plug adaptor assembly according to the present invention is shown to have a construction similar to the first embodiment. The main difference resides in that the retaining stick unit 6024 extends perpendicularly from the mounting end 6022 of the plug member 602. In order to complement the configuration of the stick unit 6024, the retention groove unit 6062 in the adaptor member 606 is a hollow groove, and is confined by a groove-defining wall 6064 having two open ends. A seating shoulder 6064S is formed adjacent to one end of the groove-defining wall 6064 such that the retaining stick unit 6024 can be seated on the shoulder 6064S, as best shown in FIG. 6B.

Figure 7A:
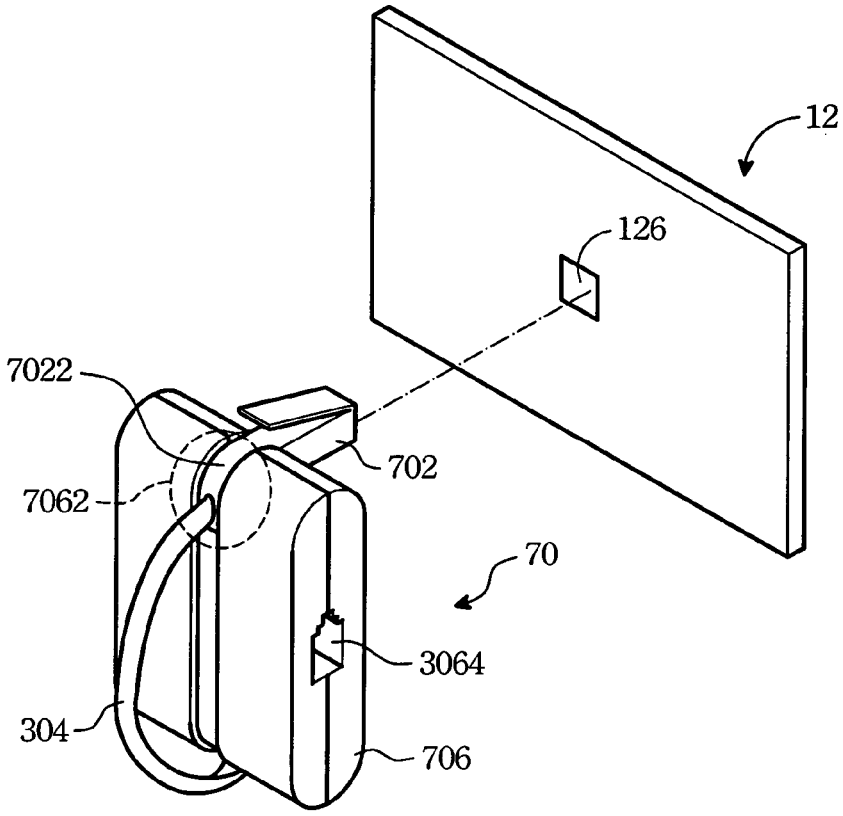
FIG. 7A is a perspective schematic view of the fifth embodiment of a plug adaptor assembly according to the present invention prior to inserting into a wall outlet.
Figure 7B:
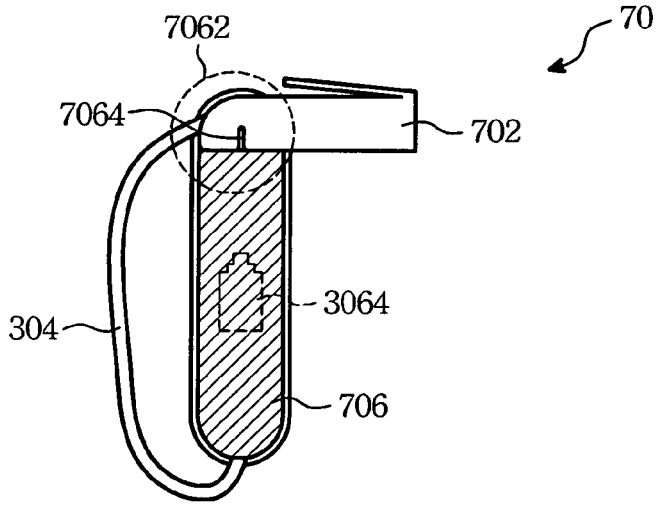
FIG. 7B is a schematic side view of the fifth embodiment of the plug adaptor assembly according to the present invention.

Referring to FIGS. 7A and 7B, the fifth embodiment 70 of a plug adaptor assembly according to the present invention is shown to have a construction similar to the first embodiment. The main difference resides in that the left and right sides of the adaptor member 706 are respectively formed with the plug holes 3064 (only one is visible in the drawings) while the retention groove unit 7062 is formed on the second end of the adaptor member 706. The bottom surface of the retention groove unit 7062 is formed with an engagement tongue 7064 that fittingly engages a hole in the plug member 702, thereby preventing untimely removal of the plug member 702 from the adaptor member 706.

Figure 8A:
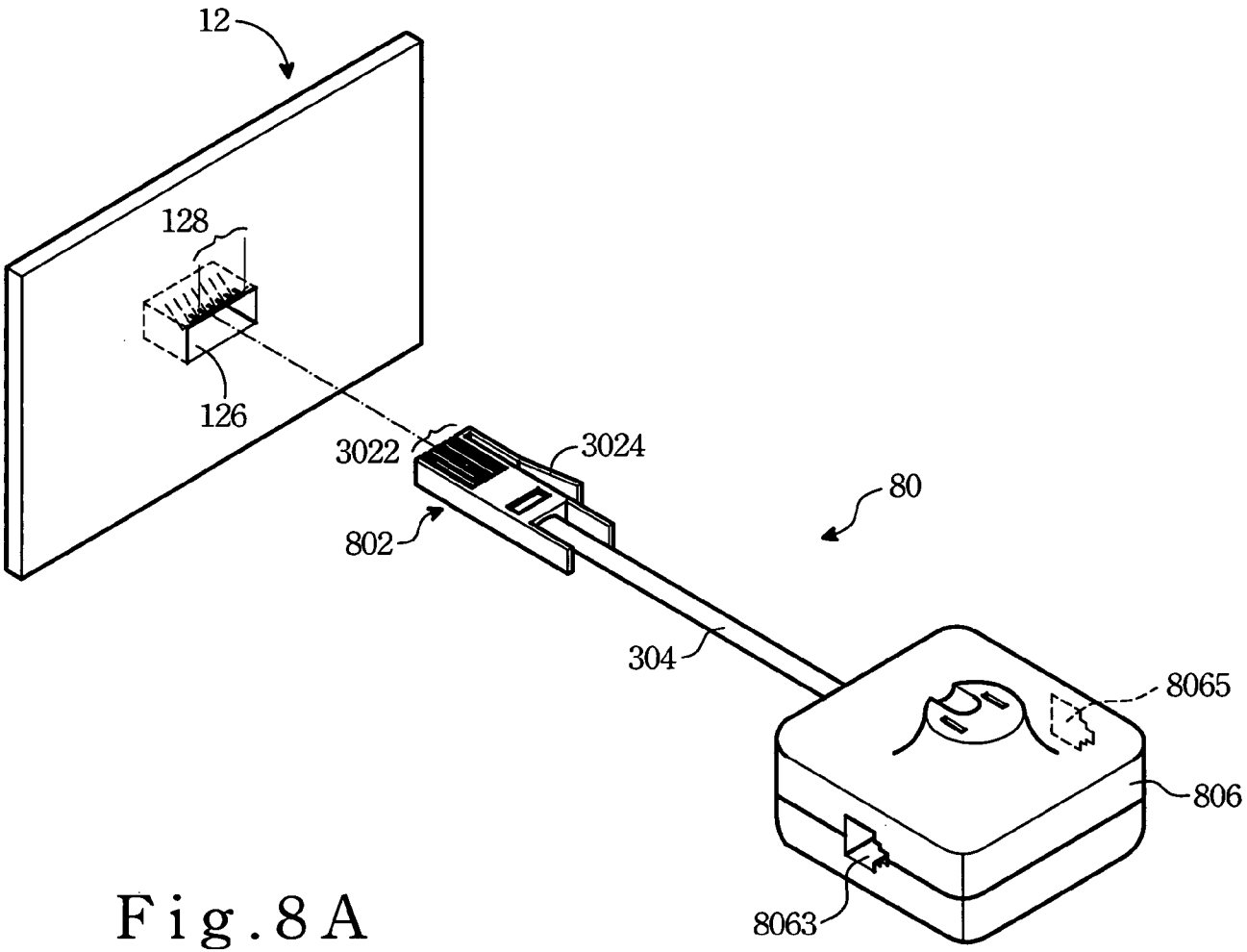
FIG. 8A is a perspective schematic view of the sixth embodiment of a plug adaptor assembly according to the present invention prior to inserting into a wall outlet.
Figure 8B:
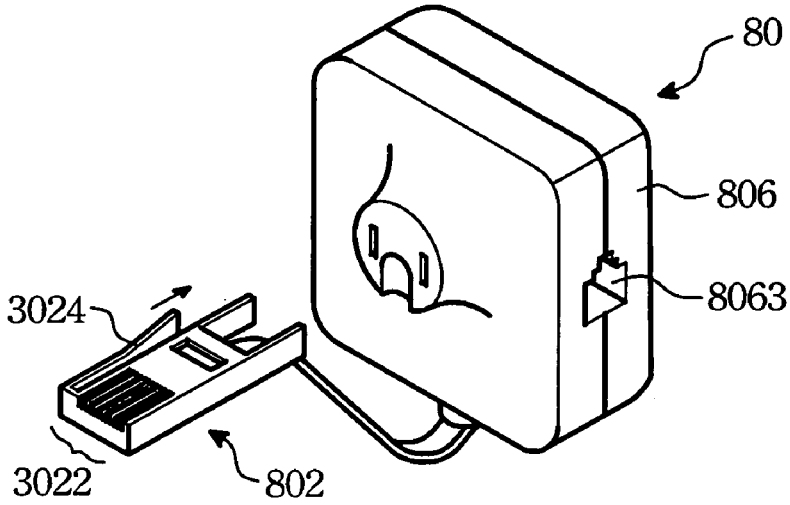
FIG. 8B is another perspective schematic view of the sixth embodiment of the plug adaptor assembly according to the present invention.
Figure 8C:
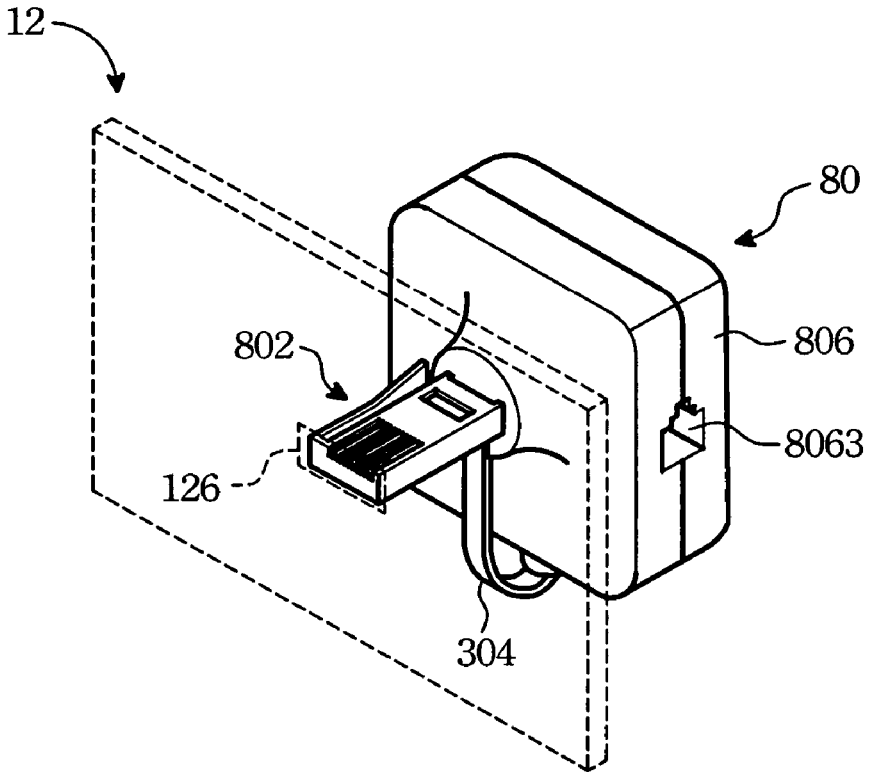
FIG. 8C is another perspective view of the sixth embodiment of the plug adaptor assembly according to the present invention in use.

Referring to FIGS. 8A to 8C, the sixth embodiment 80 of a plug adaptor assembly according to the present invention is shown to have a construction similar to the first embodiment. The main difference resides in that the adaptor member 806 is shaped like a cube, and has two pairs of equal sides, wherein one pair of the sides 806 are respectively formed with the plug holes 8063, 8065.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A plug adapter assembly for mounting on a wall that has a wall outlet formed with a plurality of terminals therein, the plug adaptor assembly comprising:

a plug member having an insert end formed with a plurality of terminals, a mounting end opposite to said insert end, upper and lower sides interconnecting said insert end and said mounting end, upper and lower sticks projecting outwardly from said mounting end and respectively flush with upper and lower sides, said insert end of said plug member being adapted to be inserted into the wall outlet in the wall for establishing electrical connection between the terminals of the wall outlet and said terminals on said insert end;

an adaptor member having a first end, a second end formed with a plug hole, a plurality of terminals disposed within said plug hole in said second end, and a mounting portion disposed between said first and second ends and formed with two grooves; and a connecting cable having opposite ends respectively connected to said mounting end of said plug member and said first end of said adaptor member for establishing electrical connection between said terminals of said plug member and said terminals of said adaptor member;

wherein, when circumstance required, said upper and lower sticks of said plug member can be respectively inserted into said grooves in said adaptor member so as to retain said plug member onto said adaptor member, thereby keeping the plug adaptor assembly in a neat-and-tidy manner.

2. The plug adaptor assembly according to claim 1, wherein each of said upper and lower sticks has a distal end formed with a V-shaped notch confining said connecting cable therein and simultaneously presses said connecting cable against said mounting portion of said adaptor member when said upper and lower sticks are respectively inserted into said grooves in said adaptor member.

3. A plug adaptor assembly for mounting on a wall that has a wall outlet formed with a plurality of terminals therein, the plug adaptor assembly comprising:

a plug member having an insert end formed with a plurality of terminals, a mounting end opposite to said insert end, at least a side interconnecting said insert end and said mounting end, and at least a retaining stick unit projecting outwardly from said mounting end and flush with said at least one side, said insert end of said plug member being adapted to be inserted into the wall outlet in the wall for establishing an electrical connection between the terminals of the wall outlet and said terminals on said insert end;

an adaptor member having a first end, a second end formed with a plug hole, a plurality of terminals located within said plug hole in said second end, and a mounting portion located between said first and second ends and formed with a retention groove unit; and a connecting cable having opposite ends respectively connected to said mounting end of said plug member and said first end of said adaptor member for establishing electrical connection between said terminals of said plug member and said terminals of said adaptor member;

wherein, when circumstance required, said at least one retaining stick unit is detachably located on said retention groove unit so as to retain said plug member onto said adaptor member, thereby keeping the plug adaptor assembly in a neat-and-tidy manner.

4. The plug adaptor assembly according to claim 3, wherein said plug member has upper and lower sides interconnecting said insert end and said mounting end, said retention groove unit including two grooves formed in said mounting portion of said adaptor member, said retaining stick unit including upper and lower sticks respectively flush with said upper and lower sides of said plug member and extending respectively into said retention grooves.

5. The plug adaptor assembly according to claim 4, wherein each of said upper and lower sticks has a distal end formed with a V-shaped notch confining said connecting cable therein and simultaneously presses said connecting cable to abut against said mounting portion of said adaptor member when said upper and lower sticks are respectively inserted into said grooves in said adaptor member.

6. The plug adaptor assembly according to claim 3, wherein said plug member has left and right lateral sides interconnecting said insert end and said mounting end, said retention groove unit including two grooves formed in said mounting portion of said adaptor member, said retaining stick unit including left and right sticks respectively flush with said left and right lateral sides of said plug member and extending respectively into said retention grooves.

7. The plug adapter assembly according to claim 6, wherein said left and right sticks cooperatively confine said connecting cable there between and simultaneously press said connecting cable to abut against said mounting portion of said adaptor member when said left and right sticks are respectively inserted into said grooves in said adaptor member.

8. The plug adaptor assembly according to claim 6, wherein said retention groove unit is a hollow groove confined by a groove-defining wall having opposite outer and inner ends, each of said left and right sticks having a distal end formed with an engaging tongue, said engaging tongues of said left and right sticks engaging a periphery defining said inner end of said groove-defining wall so as to prevent untimely removal of said left and right sticks from said adapted member when said left and right sticks are respectively inserted into said hollow groove.

* * * * *